US005128518A

United States Patent [19]

Reifel

[11] Patent Number: 5,128,518

[45] Date of Patent: Jul. 7, 1992

[54] ELECTRICALLY HEATED HORSE BIT WARMER AND HOLDER

[76] Inventor: Stanley W. Reifel, Rt. #1, Arlee, Mont. 59821

[21] Appl. No.: 500,595

[22] Filed: Mar. 28, 1990

[51] Int. Cl.[5] ..... H05B 3/00; B68B 1/06

[52] U.S. Cl. ..... 219/521; 34/202; 54/8; 219/220; 219/385

[58] Field of Search ..... 219/521, 220, 385; 34/202; 54/8

[56] References Cited

U.S. PATENT DOCUMENTS

| | | | |
|---|---|---|---|
| 1,581,426 | 4/1926 | Coons | 34/202 |
| 2,374,472 | 4/1945 | Corbett | 34/202 |
| 3,138,699 | 6/1964 | Taylor | 219/220 X |
| 3,766,361 | 10/1973 | Swinyar et al. | 219/521 |
| 4,241,290 | 12/1980 | Folland | 34/202 X |
| 4,280,316 | 7/1981 | Taylor | 54/8 |
| 4,480,394 | 11/1984 | Salas | 34/202 X |
| 4,566,254 | 1/1986 | Nagel | 54/8 |

*Primary Examiner*—Anthony Bartis
*Attorney, Agent, or Firm*—Harry M. Cross, Jr.

[57] ABSTRACT

This invention is a device that warms a horse bit while holding the bit assembly. The bit is placed on top of a cylindrical, or other shaped housing that captures the heat from an internal heat source. The housing is attached to a heat element base. The heating element that attaches to the base creates the internal heat source for the housing. The housing and base combined are secured to a vertical member or wall. All of the included parts are non-combustible under the standard of the art regulations.

4 Claims, 4 Drawing Sheets

ELECTRICALLY HEATED HORSE BIT WARMER AND HOLDER

BACKGROUND OF THE INVENTION

1. Field of the Invention

The invention of this application is a device that warms and holds a horse bit.

2. Description of the Prior Art

It is concerning to put a cold bit in a horse's mouth. It is also dangerous to insert a frozen bit in the mouth, for it will have a tendency to tear the skin from the tongue and lips.

To the best of the inventor's knowledge, the prior art in this field has not included a warming device, but rather a physical action from the horseperson. The prior art to warming a horse bit has been to hold the bit in the hand, under the arm pit, or emerge it is a bucket of water, or keeping it indoors. This invention eliminates said problems, and saves time because the bit with assembly is placed over the bit warmer while the horse is being groomed or saddled up to ride.

3. Summary

The invention relates to a cylindrical, or other, can shaped housing device that warms a horse bit. The heat source within the housing is a light bulb, or other warming element. The housing is secured to the warming element or light socket base, and this unit is secured to a vertical member. The bit is warmed by turning on the heat source and placing the bit over the housing for a few minutes. The Horse Bit Warmer and Holder enables the horseperson to be more efficient without discomfort to the person or the horse. The housing is provided with a cut-out opening, or alternately an indentation, shaped to receive the bit for heating. Vent holes may be provided on the side of the housing for additional warming of the sides of the bit.

DETAILED DESCRIPTION OF THE PREFERRED EMBODIMENT

Figure 1:
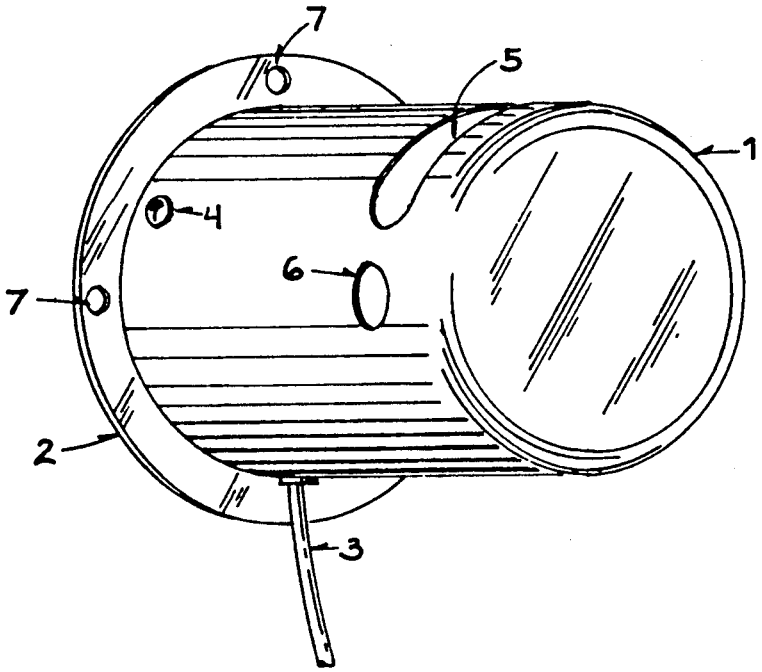
FIG. 1 is a perspective view of the HOrse Bit Warmer and Holder assembly.
Figure 2:
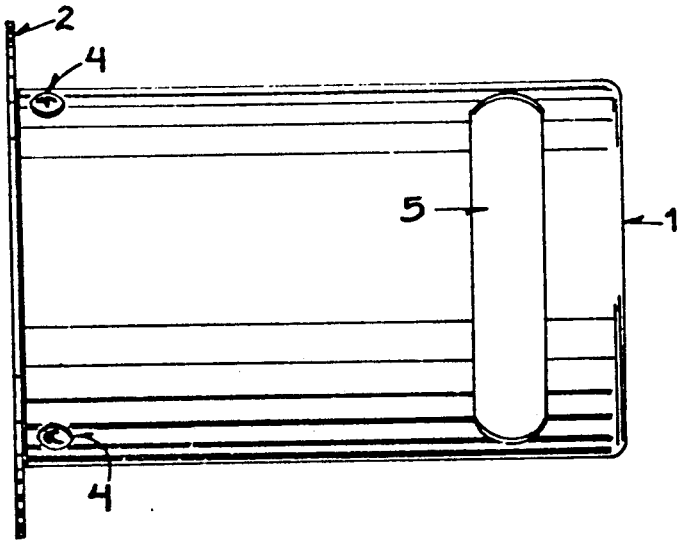
FIG. 2 is a top view of the Horse Bit Warmer and Holder assembly.
Figure 3:
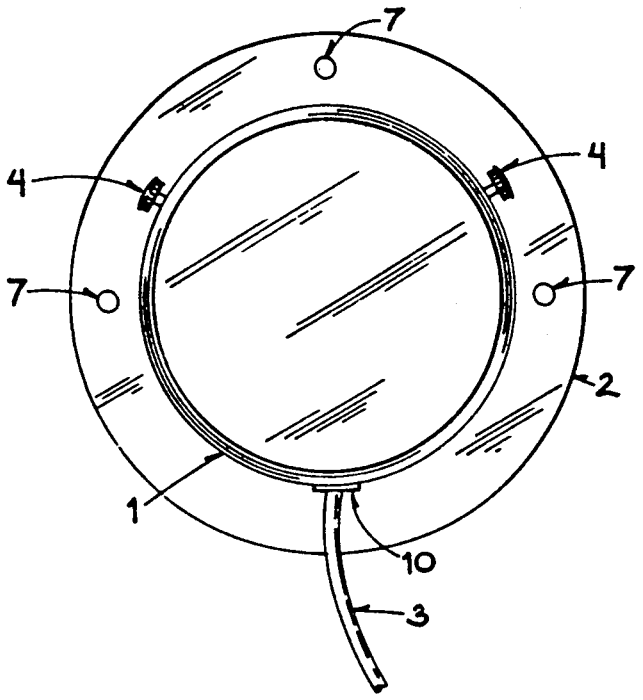
FIG. 3 is a front view of the Horse Bit Warmer and Holder assembly.
Figure 4:
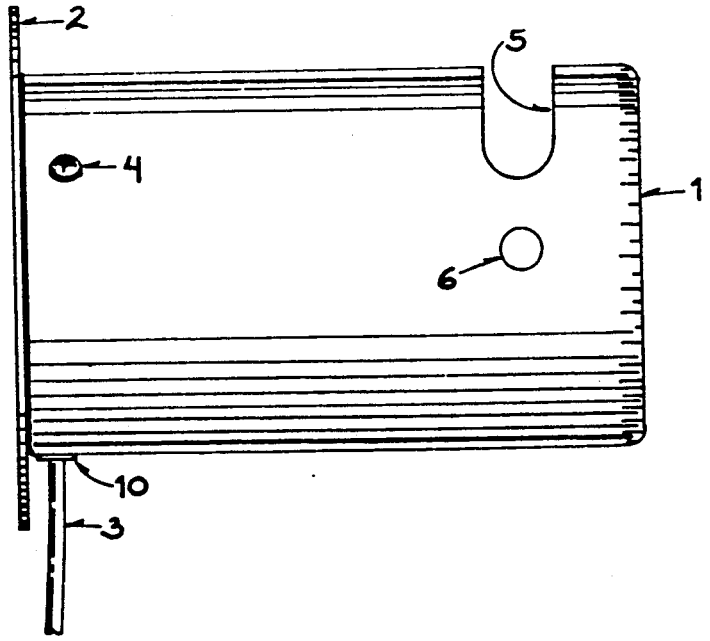
FIG. 4 is a side view of the Horse Bit Warmer and Holder assembly.

Referring to FIGS. 1, 2, 3, 4, 5 an embodiment of the Horse Bit Warmer and Holder invention is shown in which the cylindrical shaped housing 1 is secured by the knurled headed screws 4, or other means, to the light socket base and mounting assembly 2. The light socket base and mounting assembly 2 is mounted to a vertical wall or member by a fastening means through holes 7, or by other means. Undoing the fasteners 4 enables the cylindrical shaped housing 1 to be removed to change the light bulb 11, or other heat source. The heat source 11 is activated by any number of means to turn on the power source, thermostat, weight sensitive switch, micro switching, and others such as the drawn electrical cord and switch assembly 3 that is connected to a power source. This becomes the unit.

The cylindrical shaped housing 1 that covers the heat source portion 2, 8, 9, 11 of the light socket based and mounting assembly 2 has an elongated cut out opening 5 near the front of the said housing 1. Beneath and on both sides of the elongated cut out opening 5 is a vent hole means 6 for additionally warming the sides of the horse bit.

The light socket base, or heating means base, and mounting assembly 2 includes the flange for mounting , containing holes 7, and the base assembly that the light socket, 8, or heat source, attaches to 9. Said base also provides a means for power source cord 3 to attach in a safe manner 10 to the heat source means 8. Said base 2 also secures to the cylindrical shaped housing 1 with the total becoming the unit.

Figure 5:
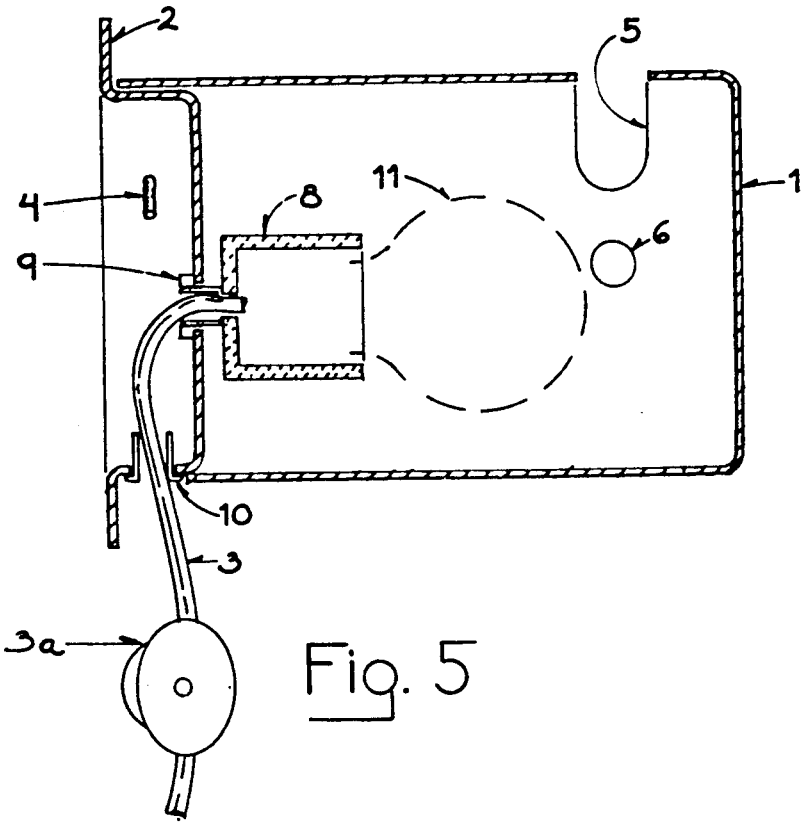
FIG. 5 is the long axis cross sectional view of the Horse Bit Warmer and Holder Assembly.
Figure 6:
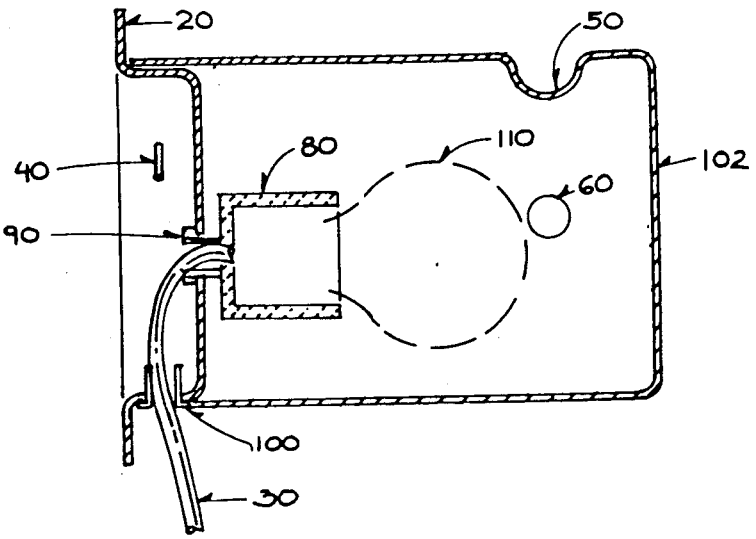
FIG. 6 is a long axis cross sectional view of another embodiment of the Horse Bit and Holder Assembly.
Figure 7:
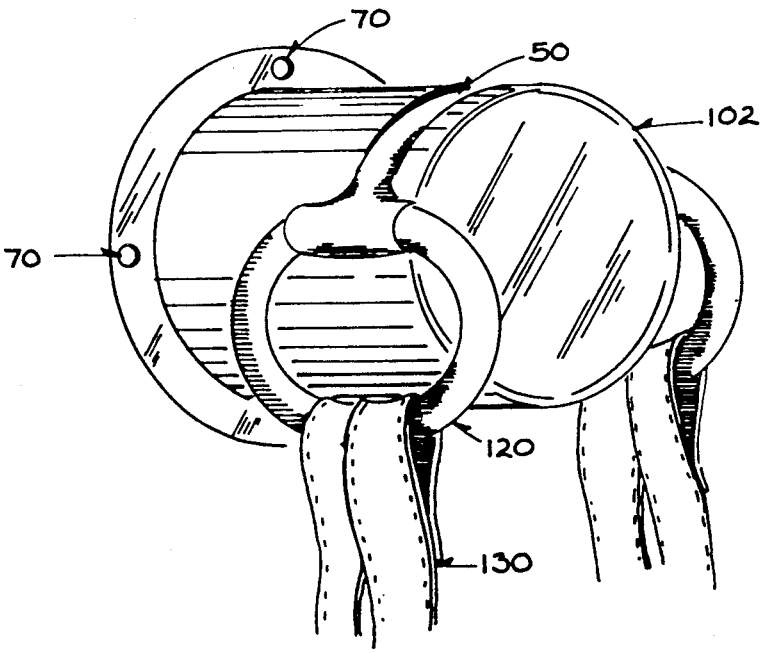
FIG. 7 is a perspective view of the FIG. 6 embodiment of the Horse Bit Warmer and Holder assembly.

Referring to FIGS. 6, 7 an embodiment of the Horse Bit Warmer and Holder invention is shown in which the cylindrical shaped housing 102 is secured by fasteners, similarly to the FIG. 1 embodiment, to the light socket base and mounting assembly 20. The light socket base and mounting assembly 20 is mounted to a vertical wall or member by a fastening means through holes 70, or by other means. Undoing the fasteners enables the cylindrical shaped housing 102 to be removed to change the light bulb 110, or other heat source. The heat source 110 is activated by any number of means to turn on the power source, thermostat, weight sensitive switch, micro switching, and others such as the drawn electrical cord and switch assembly 30 that is connected to a power source. This becomes the unit. FIG. 5 illustrates a power cord switch 3*a*.

The cylindrical shaped housing 102 that covers the heat source portion 20, 80, 90, 110 of the light socket based and mounting assembly 20 has an elongated indentation 50 near the front of the said housing 102. This indentation is arcuate and extends across the top portion of the housing and occupies a similar position to the cut out opening 5 of FIG. 1. Beneath and on both sides of the indentation 50 is a vent hole means 60 for additionally warming the sides of the horse bit 120, the reins 130 hanging freely to each side of the housing 102.

The light socket base, or heating means base, and mounting assembly 20 includes the flange for mounting holes 70 and the base assembly that the light socket, 80, or heat source, attaches to 90. Said base also provides a means for power source cord 30 to attach in a safe manner 10 to the heat source means 8. Said base 20 also secures to the cylindrical shaped housing 102 with the total becoming the unit.

Having thus fully described the preferred embodiments of the invention, and the design of the same

I claim:

1. A Horse Bit Warmer and Holder device which comprises:

a) a mounting assembly mountable on a surface;

b) a light socket base on said mounting assembly for mounting a heating means within said housing;

c) an electric heater mounted in said light socket base for energization;

d) a housing attached to said mounting assembly and having walls enclosing the light socket base and electric heater;

e) means for providing power to said light socket base for energizing the heater, comprising a switch for selective activation of said heater;

f) said housing having at least one elongated cut out opening on top thereof shaped to receive a bit and to release heat, and at least one hole below both ends of said at least one opening to warm the sides of a bit.

2. A Horse Bit Warmer and Holder device which comprises:

a) a mounting assembly mountable on a surface;

b) a resistance heating element base on said mounting assembly for mounting a hating means within said housing;

c) a resistance heating element mounted in said heating element base for energization;

d) a housing attached to said mounting assembly and having walls enclosing the heating element base and heating element;

e) means for providing power to said heating element base for energizing the heating element, comprising a switch for selective activation of said heating element;

f) said housing having at least one elongated cut out opening on top thereof shaped to receive a bit and to release heat, and at least one hole below both ends of said at least one opening to warm the sides of a bit.

3. A Horse Bit Warmer and Holder device which comprises:

a) a mounting assembly mountable on a surface;

b) a light socket base on said mounting assembly for mounting a heating means within said housing;

c) an electric heater mounted in said light socket base for energization;

d) a housing attached to said mounting assembly and having walls enclosing the light socket base and electric heater;

e) means for providing power to said light socket base for energizing the heater, comprising a switch for selective activation of said heater;

f) said housing having at least one elongated indentation on top thereof shaped to receive a bit and to release heat, and at least one hole below both ends of said at least one indentation to warm the sides of a bit.

4. A Horse Bit Warmer and Holder device which comprises:

a) a mounting assembly mountable on a surface;

b) a resistance heating element base on said mounting assembly for mounting a heating means within said housing;

c) a resistance heating element mounted in said heating element base for energization;

d) a housing attached to said mounting assembly and having walls enclosing the heating element base and heating element;

e) means for providing power to said heating element base for energizing the heating element, comprising a switch for selective activation of said heating element;

f) said housing having at least one elongated indentation on top thereof shaped to receive a bit and to release heat, and at least one hole below both ends of said at least one indentation to warm the sides of a bit.

* * * * *